US006029485A

United States Patent [19]

Böhmer

[11] Patent Number: 6,029,485

[45] Date of Patent: Feb. 29, 2000

[54] ROLLER LEVELLING MACHINE FOR LEVELLING A ROLLED SECTION

[75] Inventor: Bruno Böhmer, Erkrath, Germany

[73] Assignee: SMS Schloeman-Siemag Aktiengesellschaft, Düsseldorf, Germany

[21] Appl. No.: 09/190,426

[22] Filed: Nov. 12, 1998

[30] Foreign Application Priority Data

Nov. 17, 1997 [DE] Germany ..... 197 50 816

[51] Int. Cl.[7] ..... B21D 1/06

[52] U.S. Cl. ..... 72/7.4; 72/8.3; 72/11.1; 72/11.2; 72/37; 72/164

[58] Field of Search ..... 72/7.4, 8.3, 11.1, 72/11.2, 11.7, 37, 164, 165

[56] References Cited

U.S. PATENT DOCUMENTS

| | | | |
|---|---|---|---|
| 4,152,913 | 5/1979 | Zerhoch | 72/165 |
| 4,520,642 | 6/1985 | Niino | 72/8.9 |
| 4,583,384 | 4/1986 | Niino | 72/9.2 |

FOREIGN PATENT DOCUMENTS

| | | | |
|---|---|---|---|
| 3414486 | 10/1985 | Germany | 72/165 |
| 3729619 | 3/1989 | Germany . | |
| 195 03 850 C1 | 6/1996 | Germany . | |
| 28625 | 2/1982 | Japan | 72/165 |
| 33014 | 2/1987 | Japan | 72/164 |
| 33015 | 2/1987 | Japan | 72/164 |
| 659228 | 4/1979 | Russian Federation | 72/8.3 |
| 1346170 | 2/1974 | United Kingdom | 72/164 |

OTHER PUBLICATIONS

Brochure No. WZ/3123 "Rollenrichtmachinen Für Schwere Walzprofile Und Schienen" of SMS Schloemann–Siemag Aktiengesellschaft in Dusseldorf, DE.

*Primary Examiner*—Daniel C. Crane
*Attorney, Agent, or Firm*—Friedrich Kueffner

[57] ABSTRACT

A roller levelling machine for levelling a rolled section includes a section inlet for introducing the rolled section into the roller levelling machine and a plurality of bending rollers for levelling the rolled section. The roller levelling machine further includes at least one runout roller which is adjustable by an adjusting element for guiding the levelled rolled section. A position sensor device for determining the location of the rolled section is arranged following the runout roller at a predetermined distance from the runout roller. For transmitting the location, the position sensor device is connected to an adjusting control unit for the runout roller. The control unit is capable of determining from the determined location an adjusting signal for the adjusting element and transmitting the adjusting signal to the adjusting element. The adjusting element is configured to adjust the runout roller in accordance with the adjusting signal.

6 Claims, 2 Drawing Sheets

ROLLER LEVELLING MACHINE FOR LEVELLING A ROLLED SECTION

BACKGROUND OF THE INVENTION

1. Field of the Invention

The present invention relates to a roller levelling machine for levelling a rolled section. The machine includes a section inlet for introducing the rolled section into the roller levelling machine and a plurality of bending rollers for levelling the rolled section.

2. Description of the Related Art

Roller levelling machines of this type are disclosed, for example, in the published Brochure No. WZ/3123 "Rollenrichtmaschinen für schwere Walzprofile und Schienen" [roller levelling machines for heavy rolled sections and rails] of SMS Schloemann-Siemag Aktiengesellschaft in Düsseldorf, Germany.

In the ideal situation, an absolutely straight section is to be produced when levelling rolled sections. However, in the practical application, the rolled section is slightly bent, i.e., the section has a radius of curvature which is large, but not infinite. Consequently, the height of the arc which a rolled section includes with a chord between the ends of the rolled section is in the first approximation proportional to the square of the length of the rolled section. However, industrial standard EN 10034 requires a linear dependency of the maximum height of the arc on the length of the rolled section. Therefore, long rolled sections must have a greater straightness than short rolled sections. This leads to substantial problems in long rolled sections.

SUMMARY OF THE INVENTION

Therefore, it is the primary object of the present invention to provide a roller levelling machine which is capable of levelling even long rolled sections with the accuracy required by EN 10034.

In accordance with the present invention, the roller levelling machine includes at least one runout roller which is adjustable by an adjusting element for guiding the levelled rolled section. A position sensor device for determining the location of the rolled section is arranged following the runout roller at a predetermined distance from the runout roller. For transmitting the location, the position sensor device is connected to an adjusting control unit for the runout roller. The control unit is capable of determining from the determined location an adjusting signal for the adjusting element and transmitting the adjusting signal to the adjusting element. The adjusting element is configured to adjust the runout roller in accordance with the adjusting signal.

A reduction of the residual curvature which may still exist after levelling can be effected with various control characteristics. However, it is particularly advantageous if the control unit is constructed as a control unit with an integral component.

A particularly accurate measurement of the location of the rolled section is possible if the position sensor device includes at least one laser and at least one photosensor. For example, using lasers and photosensors, it is possible to achieve an accuracy of up to 0.1 mm. However, depending on the type of application, other sensor devices can also be used, for example, sensor devices with ultrasonic sensors.

The residual curvature of the levelled rolled section can be determined particularly accurately if the location of the rolled section is determined by the position sensor device through triangulation.

The actually levelled section can be further approximated to the desired section if the control unit has an adjustable control amplifier.

Systematic errors of levelling of the rolled section can be avoided if the location of the rolled section is varied in the vertical direction by adjusting the runout roller and if a reference bending of the rolled section is taken into consideration when determining the adjusting signal for the adjusting element.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
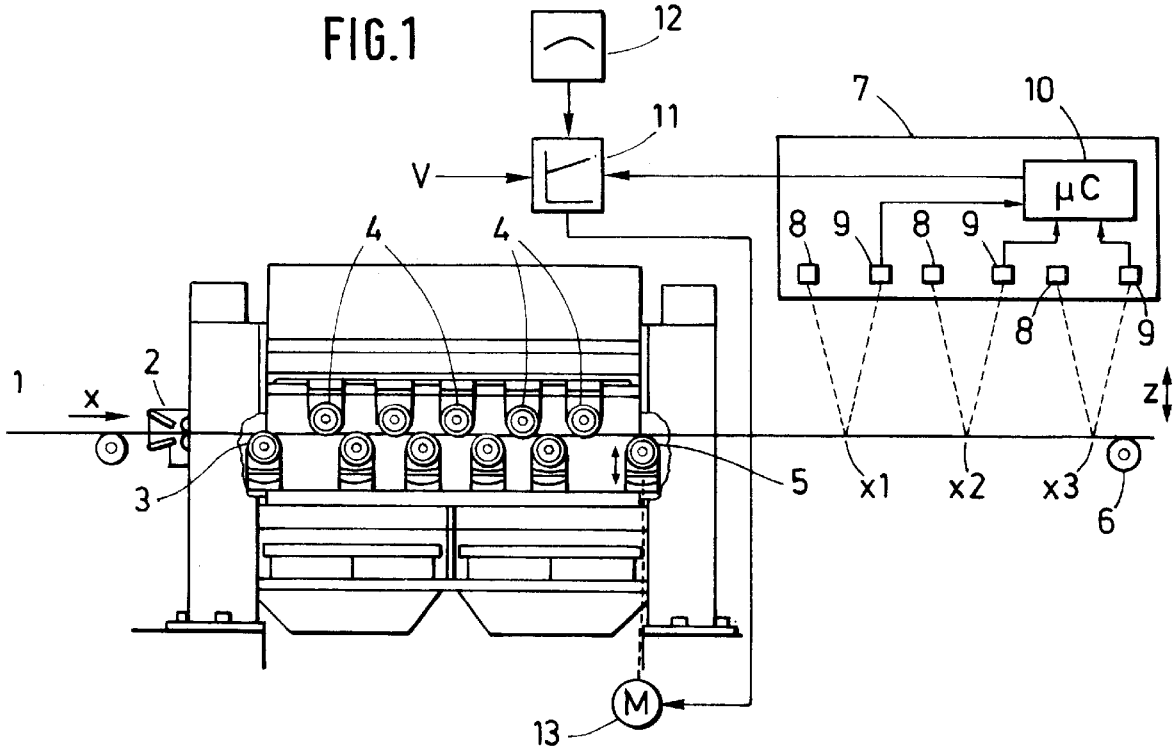
FIG. 1 is a schematic illustration of a roller levelling machine.

As illustrated in FIG. 1 of the drawing, a rolled section 1 is guided over a section inlet 2 and an inlet roller 3 toward bending rollers 4. The bending rollers 4 level or straighten the rolled section 1 in such a way that it is as straight as possible. The rolled section 1 is further guided from the bending rollers 4 over a runout roller 5 to a roller table with conveying rollers. FIG. 1 only shows one of the conveying rollers of the roller table, wherein the conveying roller is denoted by reference numeral 6. The distance between the runout roller 5 and the first conveying roller 6 of the roller table is about 3 m.

A position sensor device 7 for determining the location of the rolled section 1 is arranged between the runout roller 5 and the first conveying roller 6. The position sensor device 7 has three laser diodes 8 and three photodiodes 9. Using the diodes 8, 9, the location of the rolled section is determined at predetermined distances $x_1$, $x_2$, $x_3$ from the runout roller 5. As a result of the configuration of the system, the first girder or section piece having the length of half the distance between the levelling rollers is not measured, because this piece is not straightened.

Based on the location of the rolled section 1 determined in this manner, a microcontroller 10 then determines by triangulation the actual radius of curvature of the rolled section 1. This radius of curvature is transmitted as an actual value to an adjusting control unit 11.

In accordance with the illustrated embodiment, an initial processing of the determined locations takes place in the position sensor device 7. Alternatively, processing could also take place in the adjusting control unit 11.

Stored in a desired value transmitter 12 as a reference bending is the natural bending of the roll section 1 which would occur if the roll section 1 were levelled absolutely or ideally straight. This reference bending is provided to the control unit 11 as the desired value. Using the difference between desired value and actual value multiplied by an adjustable control amplification V, the control unit 11 then determines an adjusting signal for an adjusting element 13 which is capable of adjusting the runout roller 5 in such a way that the location of the rolled section 1 is varied in the vertical direction. The adjusting element 13 then adjusts the runout roller 5 in accordance with this adjusting signal.

In an embodiment of the present invention, the control unit 11 is a I-control unit or PI-control unit. Accordingly, the control unit 11 includes an integral component.

Figure 2:
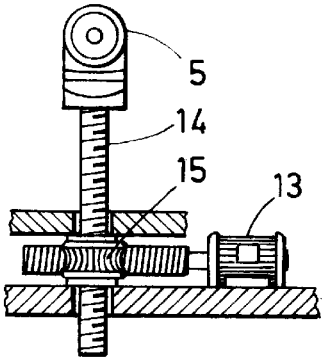
FIG. 2 is a partial schematic illustration, on a larger scale, showing the adjustment of the runout roller.

As shown in FIG. 2, the adjusting element 13 is constructed as an electric motor. Through a worm gear unit 15, the adjusting element 13 adjusts a threaded spindle 14 at whose one end the runout roller 5 is arranged. Alternatively, a direct adjustment of the runout roller 5, for example, by a hydraulic cylinder, would also be possible.

Figure 3:
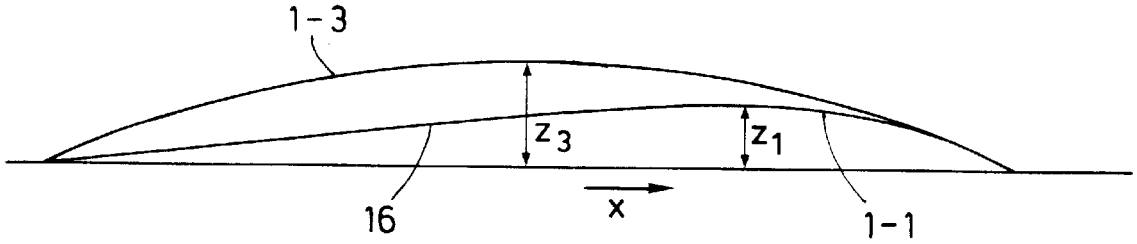
FIGS. 3 and 4 are diagrams showing curvatures of rolled sections.
Figure 4:
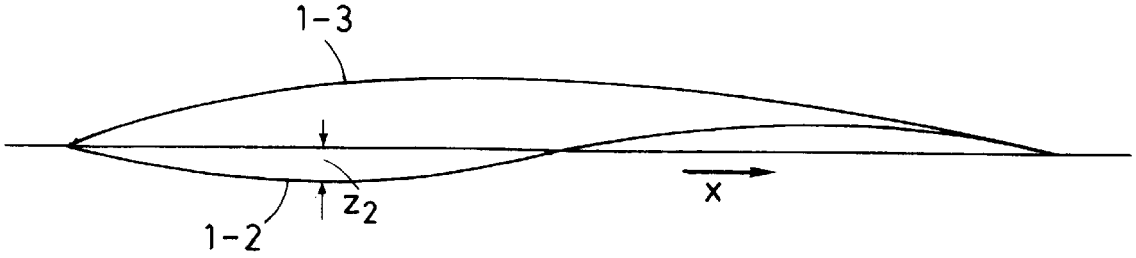

FIGS. 3 and 4 show rolled sections 1-1 and 1-2 which are obtained when levelling with the levelling machine according to the present invention is carried out. As can be seen in FIGS. 3 and 4, the rolled sections 1-1, 1-2 have significantly smaller maximum arc heights $z_1$, $z_2$ than a rolled section 1-3 which has been levelled by a roller levelling machine according to the state of the art and has a maximum arc height $z_3$. In addition, as can be seen particularly in FIG. 3, the radius of curvature of the rolled section 1-1 increases along a travel direction x, i.e., the rolled section 1-1 has become significantly straighter. In the rolled section 1-2 according to FIG. 4, in which the control unit 11 was supplied with a greater control amplification V than was the case in straightening the roll section 1-1, the arc height z even intersects zero over the travel direction x.

The roller levelling machine described above is capable of levelling the rolled section 1 in the vertical and horizontal directions. In order to influence the curvature in the horizontal plane in the same manner as described in connection with the vertical plane, it is merely necessary to determine at the locations $x_1$, $x_2$, $x_3$ not only the deviation in the z-direction, but also the horizontal deviation. The correction of the radius of curvature can then be effected through a pair of runout rollers, not illustrated for clarity's sake, which are arranged to the left and right of the rolled section 1 to be levelled and which are adjustable through an appropriate adjusting drive.

A particular advantage of the control circuit according to the present invention has been found to be the fact that it is not necessary to carry out short control steps, but that it is sufficient to control the tendency of the curvature of the rolled section.

While specific embodiments of the invention have been shown and described in detail to illustrate the inventive principles, it will be understood that the invention may be embodied otherwise without departing from such principles.

I claim:

1. A roller levelling machine for levelling a rolled section, the roller levelling machine comprising a section inlet for introducing the rolled section into the roller levelling machine, a plurality of bending rollers for levelling the rolled section, and at least one runout roller for guiding the levelled rolled section, an adjusting element for adjusting the at least one runout roller, a position sensor device located following the runout roller for determining a location of the rolled section at a predetermined distance from the runout roller, an adjusting control unit for the at least one runout roller connected to the position sensor device for transmitting the location, the adjusting control unit comprising means for determining a signal for the adjusting element from the location of the rolled section and for transmitting the signal to the adjusting element, wherein the adjusting element comprises means for adjusting the at least one runout roller in accordance with the adjusting signal, wherein the control unit is a control unit with integral control component.

2. The roller levelling machine according to claim 1, wherein the position sensor device comprises at least one laser and at least one photosensor.

3. The roller levelling machine according to claim 1, wherein the position sensor device is configured to determine the location of the rolled section by triangulation.

4. The roller levelling machine according to claim 1, wherein the control unit comprises an adjustable control amplification.

5. The roller levelling machine according to claim 1, wherein the at least one runout roller is configured to be adjusted by the adjusting element for varying the location of the rolled section in vertical direction, and wherein the control unit is configured to take into consideration a reference bending of the rolled section when determining the adjusting signal for the adjusting element.

6. A roller levelling machine for levelling a rolled section, the roller levelling machine comprising a section inlet for introducing the rolled section into the roller levelling machine, a plurality of bending rollers for levelling the rolled section, and at least one runout roller for guiding the levelled rolled section, an adjusting element for adjusting the at least one runout roller, a position sensor device located following the runout roller for determining a location of the rolled section at a predetermined distance from the runout roller, an adjusting control unit for the at least one runout roller connected to the position sensor device for transmitting the location, the adjusting control unit comprising means for determining a signal for the adjusting element from the location of the rolled section and for transmitting the signal to the adjusting element, wherein the adjusting element comprises means for adjusting the at least one runout roller in accordance with the adjusting signal, wherein the control unit is a control unit with integral control component, and wherein the control unit comprises an adjustable control amplification.

* * * * *